United States Patent [19]

Buys et al.

[11] Patent Number: 4,537,796

[45] Date of Patent: Aug. 27, 1985

[54] METHOD FOR TREATING THE SURFACE OF A CONCRETE SLAB

[76] Inventors: Romain J. B. Buys, Mandekenstraat, 141B, 9360 Buggenhout; Jean-Aimé Manouvrier, Avenue de la Rochefoucauld, 37, 1330 Rixensart, both of Belgium

[21] Appl. No.: 464,169

[22] Filed: Feb. 7, 1983

[30] Foreign Application Priority Data

Feb. 8, 1982 [BE] Belgium ..... 207255

[51] Int. Cl.[3] ..... B05D 3/12; B05D 5/02

[52] U.S. Cl. ..... 427/136; 427/264; 427/344; 427/353; 427/368; 427/421

[58] Field of Search ..... 404/19, 82; 427/136, 427/264, 344, 353, 368, 421

[56] References Cited

FOREIGN PATENT DOCUMENTS 460754 7/1913 France ..... 427/368

*Primary Examiner*—Evan K. Lawrence

*Attorney, Agent, or Firm*—Sughrue, Mion, Zinn, Macpeak and Seas

[57] ABSTRACT

In a method of roughening the surface of a concrete slab for roads to provide anti-skid properties, an agent for retarding the setting of the concrete is distributed over the slab which has been recently laid and a water-impermeable sheet of plastics material is spread over the upper surface simultaneously with the spraying operation. After the underlying or subjacent layer of concrete has set, the plastic sheet is lifted away and the still soft upper layer of concrete is removed by brushing and spraying with pressurized water.

7 Claims, 3 Drawing Figures

METHOD FOR TREATING THE SURFACE OF A CONCRETE SLAB

BACKGROUND OF THE INVENTION

This invention relates to a method of treating the surface of a slab of concrete for roads, according to which an agent for retarding the setting of the surface of the concrete is distributed over the slab which has been freshly laid, and an upper layer of mortar is removed by means of a brush.

The objective of this method is to remove the upper layer or mortar from the concrete slab between the aggregate with a view to obtaining a rough concrete. It applies in particular to the finishing of the covering of a concrete road in order to provide the road with good anti-skid properties.

PRIOR ART

A method of mechanically stripping concrete is known which comprises removing the surface mortar, once setting has started, by means of a rotating brush which is fed with water through its shaft. The mortar which has been removed is projected into a receiving tank, from where it is driven back laterally by a scraper chain.

One disadvantage of this method resides in the fact that the machine which carries the rotating brushes must necessarily be mounted astride the concrete slab.

Now, since the width of the concrete slab may amount to about 12 meters, the overhanging assembly demands a frame which is strong enough to take up the weight and absorb the strains of the rotating brushes extending over the complete width of the slab, as well as taking up the weight of the tank receiving the concrete removed by the brushes and of the scraper chain which is to laterally remove the concrete.

A second disadvantage of this known method resides in the difficulty of determining the moment when it is to be implemented. This moment is difficult to select, because the time required for the concrete to set is closely associated with the inevitable variations in the water content of the fresh concrete, with the variations in the atmospheric conditions and, in particular, with the ambient temperature, the effect of the wind and of the sun which influence the setting process on the surface of the concrete.

The time required for the concrete to set may, in effect, vary within a broad range of from 1 to 15 hours, and even longer if the temperature is low.

Another disadvantage of the known methods is that it is difficult to communicate to the chemical stripping machine the concrete discharge rate of the trucks which supply the machine for setting the concrete.

A method of chemically stripping concrete is also known from patent application FR A 2473579 which comprises the very regular application of an aqueous solution containing 15% of sugar at a rate of from 200 to 250 g of solution per square meter to the surface of a recently cast concrete slab. This solution of sugared water retards the setting of the cement in the upper layer of the slab. After from five to twelve hours, depending on the atmospheric conditions, the upper layer of concrete is removed using a motorized brush.

The disadvantages are similar to those described above. Thus, in this case as well, it is difficult to foresee the opportune moment for removing the mortar from the surface layer, the setting of which has been retarded.

Moreover, the maximum time for retarding the setting is restricted in this method. This may make it necessary to work at night.

In addition thereto, the method cannot be applied in rainy weather. In effect, there is the risk of the setting retarding agent being washed out by the rain.

Finally, to avoid the formation of fissures in the concrete, cure products consisting of, inter alia latex have to be sprayed on to the concrete, after the setting retarding agent has been applied. These products prevent the evaporation of water on the upper surface of the concrete slab. Cure products are fairly expensive. They only provide protection after drying i.e., after the formation of a fine film which has become impermeable to water. As long as they are still moist, they may thus be washed out by the rain.

Finally, different possible methods of texturing the surface of a concrete slab are known from an article entitled "Afwerking van het oppervlak van een betonweg" published in the review WEGEN, vol. 49, No. 6. June 1975 by SHAGEN.

The article mentions the spreading of sand on the slab. This sand is maintained moist by spraying with water. The article also describes the use of mats of polyester which are maintained moist, or the positioning of a covering of straw on the slab, but then combined with a cure product.

The article also teaches that in order to ensure a moisture degree which is ideal for the setting of the concrete, a certain quantity of water has to be finely sprayed on to the slab, or the slab has to be covered with water-impermeable sheets.

The article finally recognises that the most common method comprises combining the spraying of a cure product and the positioning of a mobile roof in order to prevent a possible wash-out by the rain or, while protecting the concrete slab from the rays of the sun, to avoid too rapid drying.

However, this known method does not protect the concrete slab from the effect of the wind which, while influencing the water evaporation rate, influences the setting procedure on the surface of the concrete. It does not ensure a sufficiently strict constancy in the time between the spraying of the setting retarding agent and the brushing operation.

SUMMARY OF THE INVENTION

The present invention aims to remedy the disadvantages of the above-mentioned methods. It provides a method of chemically stripping a concrete slab or a road, according to which an agent for retarding the setting of the surface of the concrete is distributed over a concrete slab by spraying as soon as it has been laid. This method is essentially characterised in that, simultaneously with the spraying of the retarding agent, a water-impermeable sheet of plastics material is spread over the upper surface of the concrete slab immediately upstream of the spraying row, and an upper layer of mortar, the setting of which has been retarded, is subsequently removed after removal of the plastic sheet, by brushing with the spraying of pressurized water between the surface aggregate, and this is carried out as soon as the concrete in the subjacent layer has set.

In a particular embodiment, the row for spraying the setting retarding agent is protected from the effect of the wind by means of a completely closed fairing which descends to about ten centimeters from the level of the concrete, so that it may be extended by the sheet of plastics material.

According to a characteristic of the present invention, the spraying of the setting retarder is protected from being washed out by the rain by covering the zone between the spraying row and the system for unrolling the plastics sheet with a roof.

The sheet of plastics material is advantageously drawn out, just above the level of the slab, by a roller which may be adjusted in height and the sheet is suitably applied to the surface of the concrete slab while a jute cloth is pulled over the sheet, the cloth being made heavier by wetting, if the force of the wind neccesitates it.

A sheet of polyethylene having a constant thickness of about 50 microns is advantageously used as the sheet of plastics material.

The present invention also provides a machine for implementing the method described above. This machine which comprises a frame, is mounted astride a concrete slab and also comprises a spraying row extending over the complete width of the above-mentioned slab, is essentially characterised in that it comprises means of supporting a chuck which is to support a roll of plastics sheet.

DETAILED DESCRIPTION OF THE INVENTION

Other characteristics and details of the present invention will be revealed by reading the description of the accompanying drawings which schematically illustrate in a non-limiting manner one embodiment of the apparatus according to this invention.

In these different Figures, the same reference notations designate indentical elements.

Figure 1:
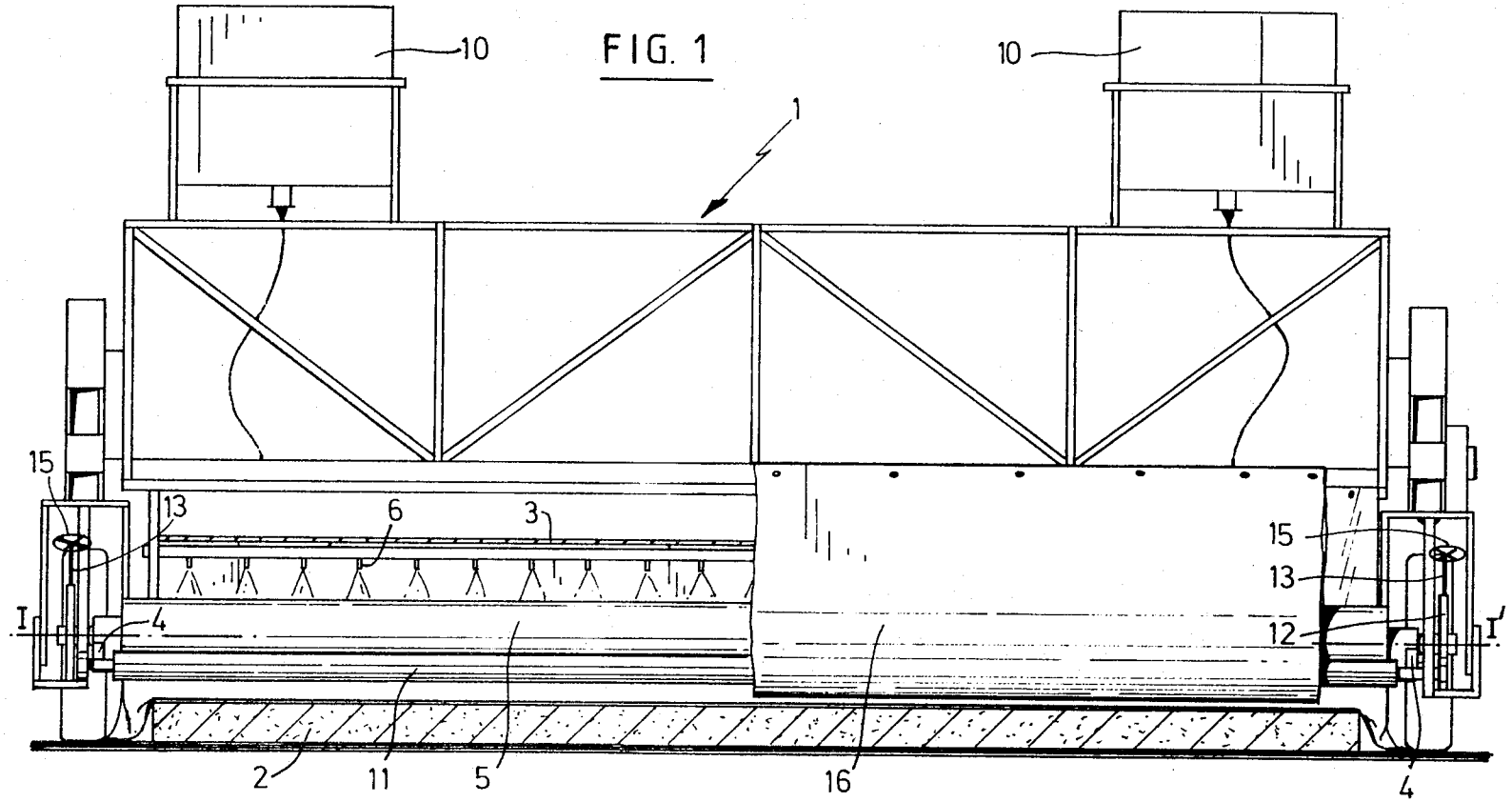
FIG. 1 is a view at one end of a machine for implementing the method of chemically stripping a concrete slab according to the present invention.
Figure 2:
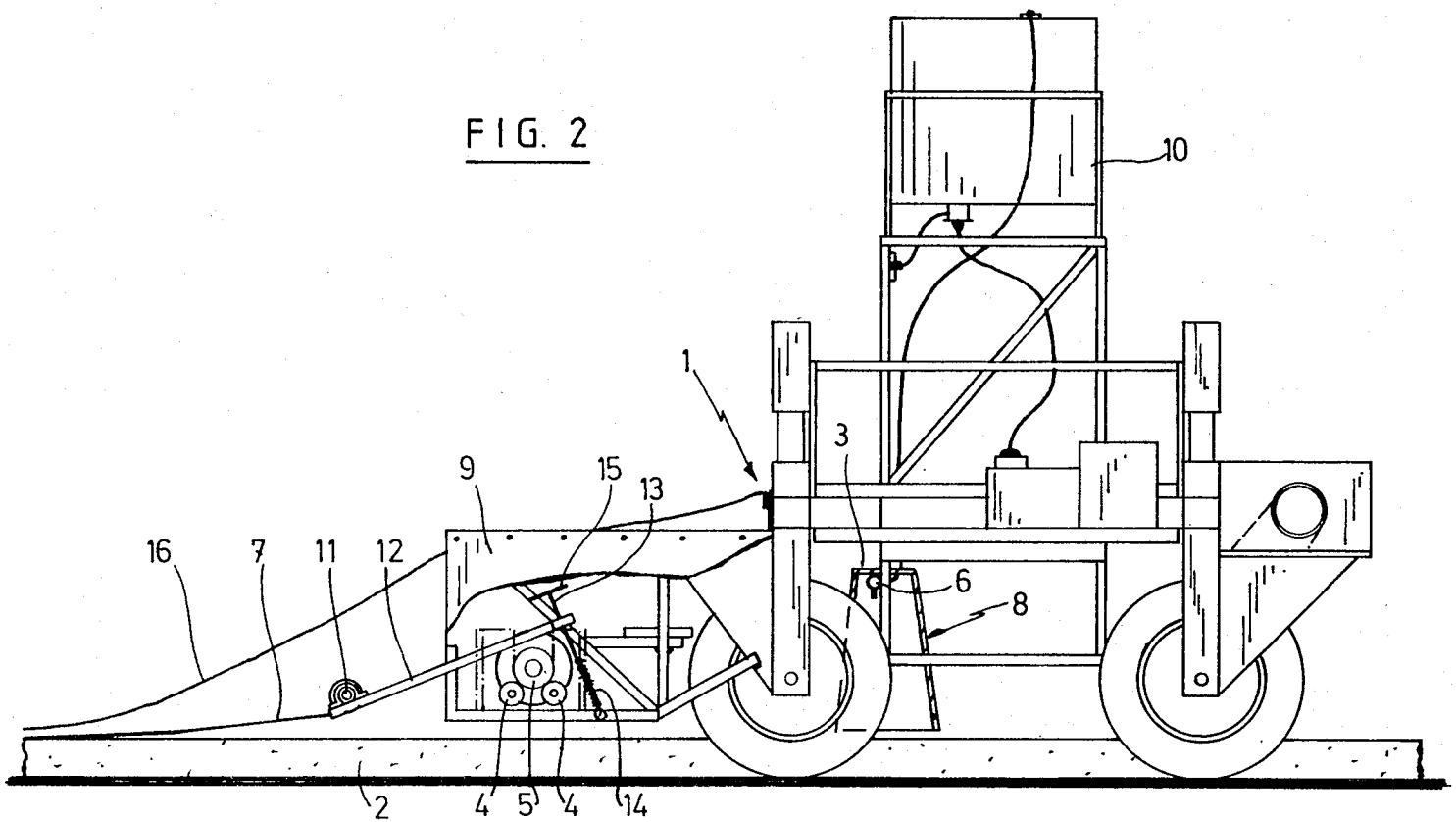
FIG. 2 is a lateral elevational view of the machine illustrated in FIG. 1.
Figure 3:
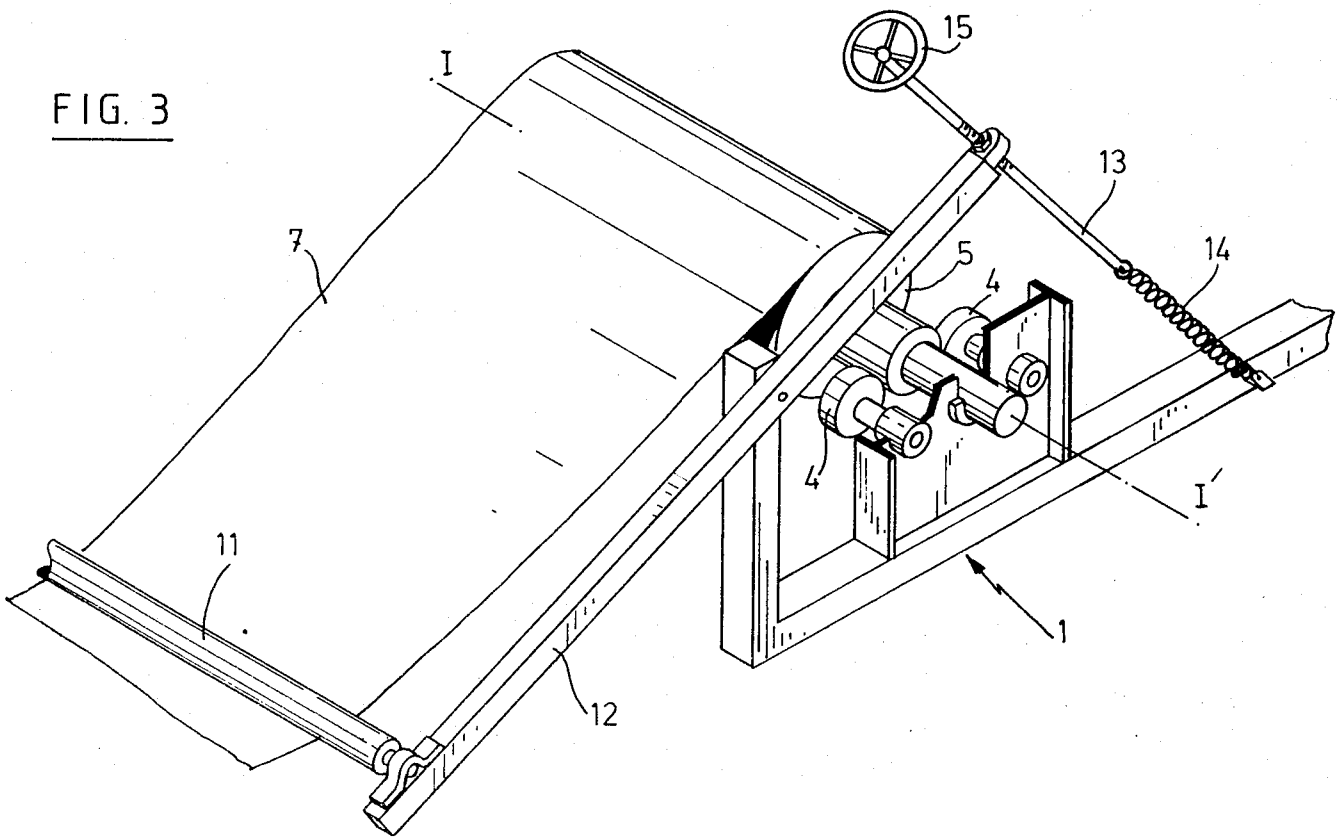
FIG. 3 illustrates the pair of rollers which are to support the chuck of the roll of plastics sheet and the draw-out roller.

As illustrated in FIG. 1, the machine for implementing a method of chemically stripping a concrete slab according to the present invention comprises a frame which is designated as a whole by reference numeral 1 and is mounted astride a concrete slab 2 which has been recently cast.

The machine is used after a compacting-finishing machine which is not shown, but is used for positioning and smoothing a concrete slab 2.

This frame supports a spraying row 3 which extends over the complete width of the slab 2. It also comprises support means 4 consisting of a pair of rollers of a similar diameter, mounted along each of the side faces of the machine at identical heights, in order to carry a roll 5 of plastics material while allowing the roll to rotate about a substantially horizontal axis I-I'.

The setting retarding agent is distributed by spraying using an agricultural type of sprinkling row connected to two reservoirs 10. The row 3 extends over the complete width of the slab 2 in order to distribute the setting retarding agent uniformly over the concrete slab 2 by means of nozzles 6.

In order to allow a visual control of the distribution homogeneity of the setting retarder, a pigment is advantageously added to the solution to be sprayed. This pigment allows the required proportion to be approached as closely as possible. It also allows the level of the spraying row 3 to be adjusted with respect to the concrete so that there is a mutual covering by the jets from the various nozzles 6. This level adjustment of the row makes it possible to obtain a homogeneous distribution of the retarder over the concrete slab 2.

The spraying row 3 is protected from the wind by a hood 8 which completely surrounds the row, and by a fairing 9 descending to from 10 to 15 cm from the surface of the concrete.

The quantity of retarding agent solution to be sprayed per square meter is determined by experiments as a function of the degree of stripping which is required or desired.

This determination being fixed, the metering is effected as a function of the flow rate of the row and of the movement speed of the machine which must be constant within as narrow limits as possible.

Slight variations are accepted provided that the quantity of retarder provided per square meter is about 500 $g/m^2$ of solution. Such a concentration restricts the occurence of variations in proportion due to the variations in movement speed of the spraying machine.

It is imperative that the required proportion is observed.

In this respect, it is worthwhile to note that too little retarding agent may result in too slight a stripping action and at the limit even render it impossible. The only alternative solution, in this case, for complying with the requirements is mechanical roughening, a procedure which is very expensive.

Too much product results in too deep a stripping action which, at the limit, possibly risks causing the exposure of stones during the subsequent brushing operation.

When the machine which supports the spraying row 3 stops, the nozzle 6 allow what remains in the row to flow out onto the concrete. This has to be avoided by providing a mobile gutter which is slipped under the row at each stop.

In the method according to the present invention, a sheet of water-impermeable plastics material 7 is spread over the upper surface of the concrete slab which has been recently cast and smoothed.

The sheet of plastics material 7 mentioned above is drawn out over the concrete slab 2 by means of a draw-out roller 11 mounted at the end of a pair of levers 12 which may be adjusted in height due to threaded shanks 13, attached to the edge of the frame 1 by springs 14 and activated by a flywheel 15.

The sheet of plastics material 7 is applied to the concrete slab 2, while possibly being covered by a jute cloth 16 which is pulled thereover and is wetted if the force of the wind necessitates it.

The surface layer of concrete, the setting of which has been delayed, is removed as soon as the subjacent layer affords a mechanical strength which is sufficient to allow the movement of the brushing device on the slab without any degradation thereof, generally at least after 24 hours.

The polyethylene sheet 7 is firstly drawn back on a section of road over a length corresponding to that which is expected to be able to be brushed immediately. Thus, it is possible to avoid removing the polyethylene from too large a surface, because the mortar dries on the surface and forms a crust which is more difficult to remove. To avoid the formation of this crust in hot weather, it is even advantageous to spray the surface to be treated beforehand.

The protecting sheet of plastics material which is used in combination with the use of the retarder according to the present invention has a multiple function:

to protect the concrete from risks of fissuring up until the time when the surface layer is brushed;

to protect the retarder from all risks of bad weather;

to maintain the efficiency of the setting retarder whatever the atmospheric conditions, sun, wind, rain, up until the time of brushing which may be up to 72 hours (that is±3 days after the concrete has been laid).

It is the use of the retarder and its simultaneous protection by the plastics sheet which provides the above-mentioned advantages. By protecting and isolating the retarder under the plastics sheet, the efficiency is maintained within the time.

The method described above allows the concrete to be laid, even in rainy weather with, however, some constraints, i.e., covering the concrete supplying trucks with a tarpaulin and working to the nearest point of the machine for laying the concrete. It is quite a considerable advantage for the efficiency of the sites.

Under these conditions, the use of a polyethylene sheet may be more advantageous than the use of a cure product up until the time when the mortar is removed, and it is certainly more advantageous if the time between the spraying of the retarder and the brushing operation amounts to about 72 hours, because the cure product is no longer necessary thereafter.

The polyethylene sheet is easily removed from the surface of the concrete and the upper layer of mortar which is thus exposed and has still not set may be removed without too much effort.

Thus, it is possible to precisely adjust the degree of lowering of the brush into the concrete for carrying out the stripping operation.

The operation is best carried out by adjusting the level of the ends at a few millimeters below the surface of the concrete.

Thus, under the best conditions. the dynamic projection effect which is exerted by the ends in rotation is used, there is no premature wear and the ends do not tend to bend in a permanent manner.

The sheet of plastics material positioned on the surface of the concrete slab, immediately after the slab has been laid, replaces very advantageously and more reliably the cure product up until the time selected for the stripping operation and the economy which is provided becomes even more appreciable when the production conditions of the concrete make it possible to remove the mortar after±72 hours.

The present invention makes it possible to adapt the composition of the aqueous solution of the setting retarder with a view to obtaining reproducible results, whatever the atmospheric conditions, and also makes it possible to be able to vary the time between the spraying of the retarder and the removal of the mortar.

This invention also allows the use of a solution which is sufficiently viscous to avoid the natural away-flow of the product in the inclines which are usually encountered on roads. To produce this condition, the kinematic viscosity measured in a Ubbelohde viscosimeter is about $12\times10^{-4}$ $m^2$/sec.

This viscosity does not prevent the penetration of retarder into the concrete, as could be the case in other known methods. Moreover, this method allows a little more latitude in the penetration time of the retarder, since the sheet of plastics material protects this operation in a permanent manner.

Due to the method according to the present invention, it is possible to fix the time which has to elapse between the spraying of the retarding agent and the passage of the brushing device which is to remove the retarded mortar, at a minimum of 24 hours. This rules out any risk of degradation of the concrete slab.

It is clear that the present invention is not restricted to the details described above, and that numerous modifications may be made to these details without departing from the scope of the invention.

We claim:

1. A method of chemically stripping a concrete slab, comprising the steps of: distributing an agent for retarding the setting of an upper layer of mortar on the surface of a freshly laid concrete slab by spraying said agent from a row of nozzles, simultaneously spreading a water-impermeable sheet of plastics material over said upper layer immediately upstream of said spraying nozzles, and, as soon as the concrete in a layer subjacent to said upper layer has set, removing said sheet, then removing said upper layer of mortar whose setting has been retarded from between surface aggregates in the concrete by simultaneously brushing and spraying with pressurized water.

2. A method according to claim 1, in which spraying of said retarding agent is protected from the effect of wind by a fairing extended by said plastics sheet.

3. A method according to claim 1, in which said setting retarder is protected from being washed out by rain by covering the zone between said spraying row and the system for unwinding said plastics sheet with a roof.

4. A method according to claim 1, in which said plastics sheet during spreading is drawn out just above the level of said slab by a draw-out roller which is adjustable in height.

5. A method according to claim 1, in which said plastics sheet is suitably applied to the surface of the concrete slab while a jute cloth is pulled over the sheet and made heavier by wetting to overcome the force of the wind.

6. A method according to claim 1, in which said plastics sheet has an extra width on both sides of the concrete slab so that it is effectively held by means of the additional material up until the brushing operation.

7. A method according to claim 1, in which a sheet of polyethylene having a constant thickness of about 50 microns is used as said sheet of plastics material.

* * * * *